US011535474B2

(12) United States Patent
Loippo et al.

(10) Patent No.: US 11,535,474 B2
(45) Date of Patent: Dec. 27, 2022

(54) METHOD FOR TRANSPORTING A TAIL END IN A FIBER WEB MACHINE FROM ONE STRUCTURAL SECTION TO ANOTHER, AND ALSO AN APPARATUS AND THE USE OF IT

(71) Applicant: RUNTECH SYSTEMS OY, Kolho (FI)

(72) Inventors: Kimma Loippo, Kolho (FI); Juhani Lehto, Kolho (FI); Markku Kajander, Kolho (FI); Mertsi Lindeman, Kolho (FI)

(73) Assignee: Runtech Systems OY, Kolho (FI)

( * ) Notice: Subject to any disclaimer, the term of this patent is extended or adjusted under 35 U.S.C. 154(b) by 466 days.

(21) Appl. No.: 16/497,719

(22) PCT Filed: Mar. 22, 2018

(86) PCT No.: PCT/FI2018/050215
§ 371 (c)(1),
(2) Date: Sep. 25, 2019

(87) PCT Pub. No.: WO2018/178511
PCT Pub. Date: Oct. 4, 2018

(65) Prior Publication Data

US 2020/0031600 A1 Jan. 30, 2020

(30) Foreign Application Priority Data

Mar. 31, 2017 (FI) ..... 20175301

(51) Int. Cl.
*B65H 20/14* (2006.01)
*D21G 9/00* (2006.01)

(52) U.S. Cl.
CPC ..... *B65H 20/14* (2013.01); *D21G 9/0063* (2013.01); *B65H 2301/522* (2013.01); *B65H 2404/6111* (2013.01); *B65H 2801/84* (2013.01)

(58) Field of Classification Search
CPC ..... B65H 20/14; B65H 2301/522; B65H 2404/61111
See application file for complete search history.

(56) References Cited

U.S. PATENT DOCUMENTS 3,705,676 A 12/1972 Overly et al.
4,014,487 A * 3/1977 Reba ..... B29C 43/22 226/5

FOREIGN PATENT DOCUMENTS

DE 9109313 U1 * 9/1991 ..... D21G 9/0063
DE 102008002346 A1 * 12/2009 ..... B65H 20/14

(Continued)

OTHER PUBLICATIONS

Machine Translation of DE 91 09 313 U1, Sep. 26, 1991. (Year: 1991).*

(Continued)

*Primary Examiner* — William E Dondero
(74) *Attorney, Agent, or Firm* — Kevin E. West; Advent, LLP

(57) ABSTRACT

An apparatus for transporting a tail end in a fiber web machine from one structural section to another includes nozzles for guiding the tail end on the guide plate by means of an air flow such that the blown air is brought onto a guide plate shaped into a curve in such a way that the air flow of the blown air guides the tail end onto the curved guide plate by means of a bump functioning as an aerodynamic profile formed in the curved guide plate.

20 Claims, 28 Drawing Sheets

(56) References Cited

FOREIGN PATENT DOCUMENTS

Figure 1A:
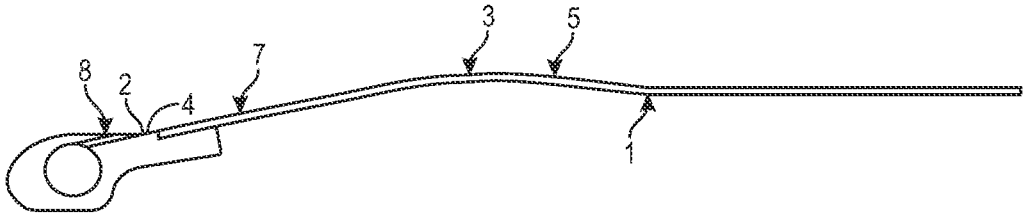

| | | | |
|---|---|---|---|
| FI | 78528 | B | 4/1989 |
| FI | 115233 | B | 3/2005 |
| FI | 124219 | B | 5/2014 |
| FI | 20145349 | A | 10/2015 |
| GB | 1509506 | A | 5/1978 |
| WO | 9803418 | A1 | 1/1998 |

OTHER PUBLICATIONS

International Preliminary Report and Written Opinion on Patentability for International Application No. PCT/FI2018/050215, dated Oct. 10, 2019 (8 pages).
Office Action for Finish Application No. 20175301, dated Nov. 30, 2017 (6 pages).
Search Report for Finish Application No. 20175301, dated Nov. 30, 2017 (2 pages).
Office Action for Finish Application No. 20175301, dated Jul. 12, 2018 (1 page).
International Search Report for International Application No. PCT/FI2018/050215, dated Jul. 3, 2018 (5 pages).
Written Opinion for International Application No. PCT/FI2018/050215, dated Jul. 3, 2018 (7 pages).

* cited by examiner

METHOD FOR TRANSPORTING A TAIL END IN A FIBER WEB MACHINE FROM ONE STRUCTURAL SECTION TO ANOTHER, AND ALSO AN APPARATUS AND THE USE OF IT

CROSS-REFERENCE TO RELATED APPLICATIONS

This is a U.S. national stage entry of International Patent Application No. PCT/F12018/050215, filed on Mar. 22, 2018, which claims priority to Finnish Patent Application No. 20175301, filed on Mar. 31, 2017, the entire contents of all of which are fully incorporated herein by reference.

The present disclosure is directed to a method for transporting a tail end in a fiber web machine from one structural section to another in such a way that it is guided from the transfer plates by means of an air flow. The disclosure also relates to an apparatus and to the use of it.

Various solutions are known in the art that are aimed at improving the transfer of a tail end from one structural section to another. Web feeding in fiber web machines, such as in paper machines and board machines, is to an increasing extent air-assisted. They are safe and generally also operationally reliable, as well as being inexpensive to build and use. Solutions known in the art have had a number of drawbacks, e.g. an advantageous airflow speed has not been achieved to the transfer plates. In this respect, the efficiency of apparatus today has not essentially improved. The state-of-the-art is described in applications FI20145349, FI20060757 and also in patents FI 123352 an FI 122377.

It is an object of the present invention to provide a new type of solution for managing web threading in the different parts of the machine, and for different speeds and grades. The solution now utilizes airflow theory more efficiently and at the same time the operation of the apparatus is optimized; the airflow of the blown air can now be directed more accurately at the guide plate. By means of the invention, an even curtain of air can be formed on the guide plate without friction.

More precisely specified, the invention is characterized by what is stated in the claims.

In the following, the invention will be described in more detail with reference to the attached drawings, wherein:

FIGS. 1-10 present a simplified apparatus for transferring a tail end from one structural section to another and also basic diagrams of various possible embodiments of the solution according to the invention.

According to FIGS. 1A-1D, in the invention the airflow 4 of blown air 2 is brought to the surface of the guide plate by means of the special shape of the guide plate. A bump 3 guiding the airflow is shaped in the guide plate 1. This means a curved protrusion that is shaped in the guide plate 1 in such a way that, as viewed from the side, the bump 3 makes a controlled wave-shaped bulge compared to a straight plate. The guide plate 1 is fabricated from metal, plastic, carbon fiber or a corresponding composite. It is generally known in the art to use guide plates that are straight in the longitudinal direction, onto which the blown air is directed. According to FIG. 1D, in the invention the use of a curved guide plate 1 is essential for transporting the tail end 6 in a fiber web machine from one structural section to another in such a way that the tail end 6 is guided on a guide plate by means of an air flow 4.

Broadly interpreting the state-of-the-art, as an illustrative concept the solution can be generally compared to the functioning of the top part of an airplane wing. The aerodynamic profile of the bump 3 guides the air flow 4 of the blown air 2. From the standpoint of the invention, however, what is essential is the technical solution with which the air flow 4 of the blown air 2 can be guided onto the surface of the guide plate 1 and how the air flow 4 is controlled in its entirety.

The purpose of the invention is that the air flow 4 of the blown air 2 is guided along the streamlined surface 5 of the bump 3 functioning as an aerodynamic profile. The air flow 4 of the blown air 2 follows the shape of the surface 5 of the bump 3 and keeps the airflow 4 under the control of the surface 5. In other words, the air flow 4 of the blown air 2 is made to cling to the surface of the bump 3 and to follow it by means of the curved guide plate 1. In this way, the air flow 4 of the blown air 2 adheres to the surface 5 and the tail end 6 can be guided in the direction of the curved guide plate 1.

Figure 1B:
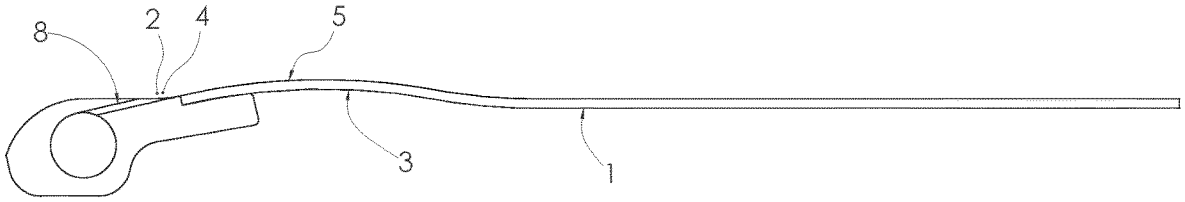
Figure 1C:
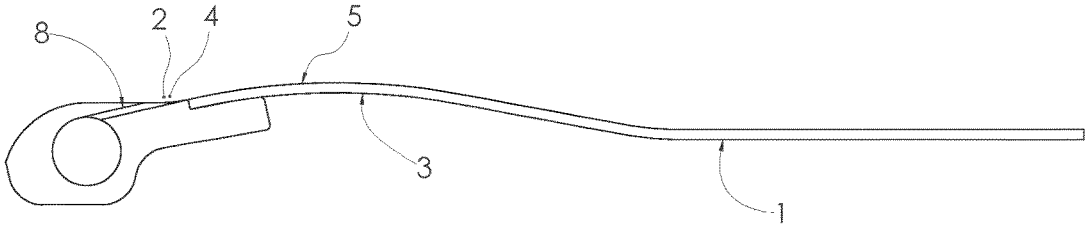
Figure 1D:
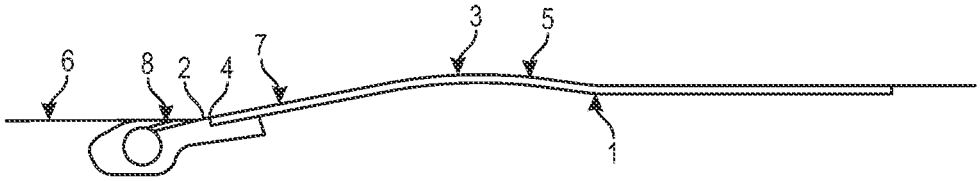

According to FIGS. 1B and 1C, the aerodynamic bump 3 of the curved guide plate 1 is most preferably formed to start very close to the point from which the blown air 2 is brought to the surface of the guide plate 1, even in such a way that the air flow 4 leaves to immediately follow in a streamlined manner the shape of the surface 5 of the bump 3. Another alternative is presented in FIG. 1A, in which the air flow 4 of the blown air 2 passes first on a straight part 7 formed in the guide plate 1, after which the aerodynamic bump 3 starts. An alternative solution could also be that, instead of a straight section 7, before the aerodynamic bump 3 a step smaller than the bulge could be formed, as a surface curving upwards, or otherwise a recess, as a surface curving downwards.

Figure 4A:
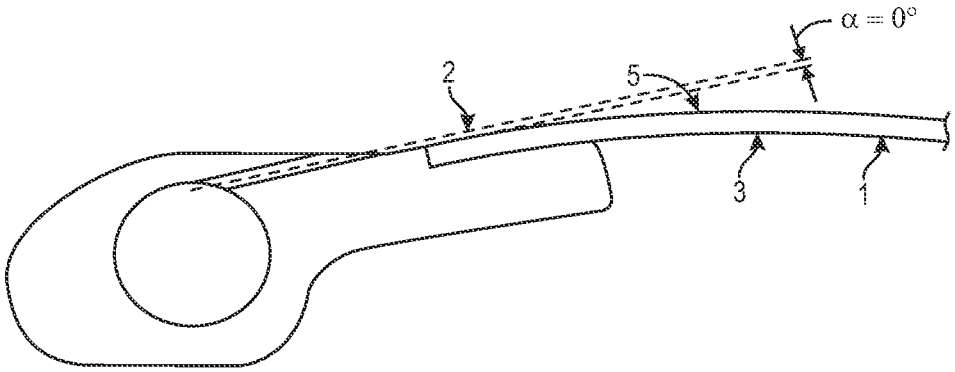
Figure 4B:
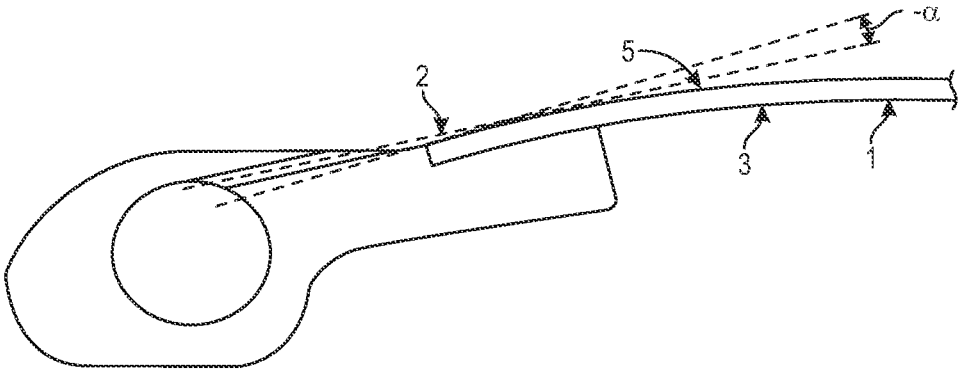
Figure 4C:
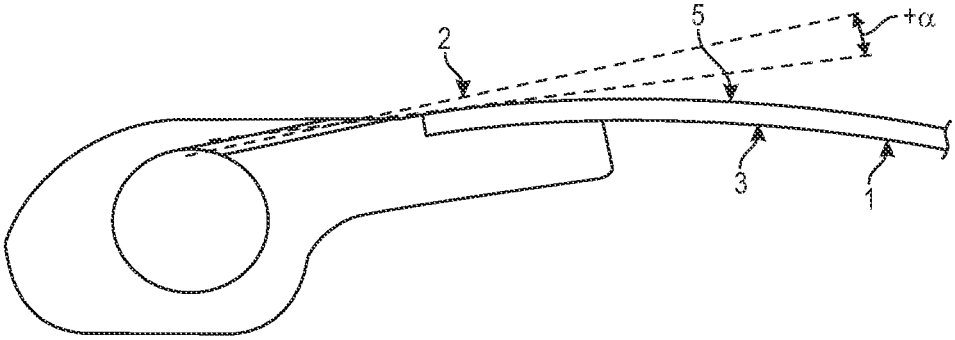

According to FIG. 4A, in the invention the blown air 2 can be guided onto the surface of the curved guide plate 1 either fully in the direction of the travel direction of the guide plate 1, i.e. without any angle $\alpha=0°$. Alternatively, according to FIG. 4B, by modifying the shape of the bump 3 of the curved guide plate 1, the blown air 2 can be guided onto the surface of the guide plate 1, or into the proximity of it, either at a negative angle $-\alpha$, i.e. the blown air 2 is guided towards the surface 5 of the bump 3 formed in the guide plate 1, or at a positive angle $+\alpha$ according to FIG. 4C, at which the blown air 2 is guided upwards from and/or away from the surface 5.

From the standpoint of the invention, completely new opportunities are created in particular by the possibility of guiding the blown air 2 onto the surface of the curved guide plate 1 at a negative angle $-\alpha$, i.e. the airflow 4 of the blown air 2 is made to collide with the surface 5 of the bump 3 at the desired point. With this arranged collision, it is possible to modify the spreading of the air being blown onto the surface of the guide plate 1 in exactly the manner desired and to guide it onwards onto the tail end 6. Most typically, this brings about a more even distribution of the force pulling the tail end 6, such as a paper tail, i.e. the force is not so point-formed.

Figure 2A:
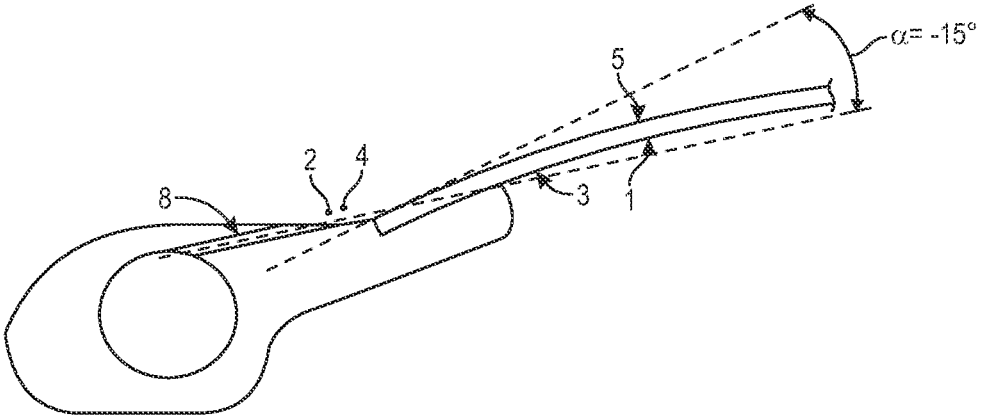
Figure 2B:
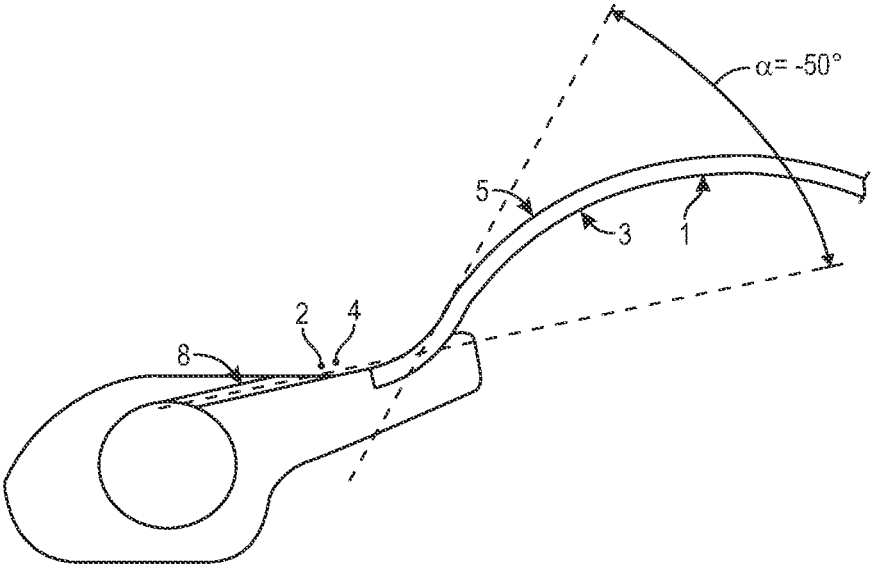
Figure 2C:
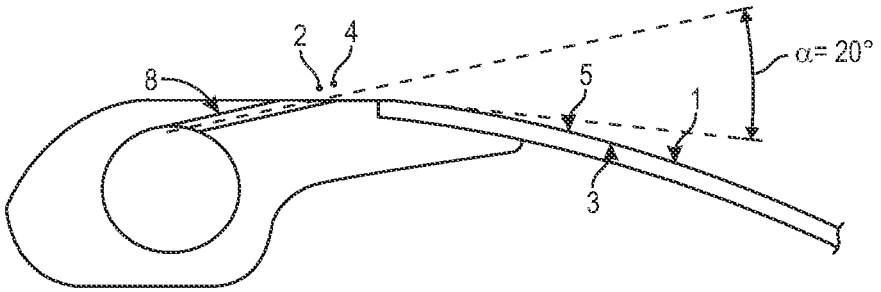

From the standpoint of the invention, the aforementioned angle $+/-\alpha$ between the blown air 2 and guide plate 1 is $-50°$-$+5°$ degrees; it can vary greatly depending on the different operating sites. In principle, even a $+20°$ positive angle could be used, although certainly in practice from the standpoint of the invention the most favorable angle $+/-\alpha$ is in the range $-15°$-$+5°$ and the optimum angle $-5°$-$+5°$. By way of illustration, FIGS. 2A-2C present the extreme embodiments $-50°$ and $+20°$ as well as embodiment examples of a more applicable $-15°$ angle. For this reason, it is essential to factor in that the shape of the curved guide plate 1 can vary very much indeed. The shape of the curved guide plate 1 has been developed on the basis of technical calculations and the combined data of practical test runs. The curved shape is modified and fine-tuned, so that the shape would produce in the flowing air a fairly similar phenomenon to what happens on an airplane wing. It is completely obvious to the person skilled in the art, however, that neither the shape nor the structure of an aircraft wing can be utilized in the solution according to the invention, because what is involved is a completely different intended use, and the technical conditions are in no way comparable.

A solution is sought in the invention for the shape of the guide plate 1 for transporting a tail end 6 in a fiber web machine. It is important for the invention that the air flow 4 strongly follows the shape of the curve, very close to the surface 5 of the curve, without appreciably trying to disperse away from the surface of the curve. This is an important advantage, because in a flat tail end the air mattress tries to become thicker on the surface of the plate as a function of the distance from the blowing nozzle. The curved shape of the guide plate 1 minimizes this effect and keeps the air mattress thin. This considerably improves the control of the tail 6 in threading and enables the use of smaller air volumes, which in turn improves the energy efficiency of this solution. Important observations were made in test runs, and by means of technical solutions the shape of the curved guide plate 1 was optimized in such a way that the air flow 4 of the blown air 2 follows the streamlined shape of the surface 5 of the bump 3 functioning as an aerodynamic profile and keeps the airflow 4 under the control of the surface 5.

Figure 5A:
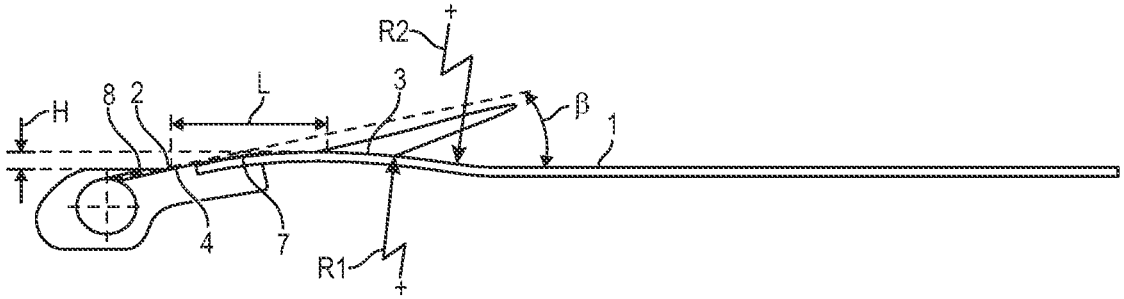
Figure 5B:
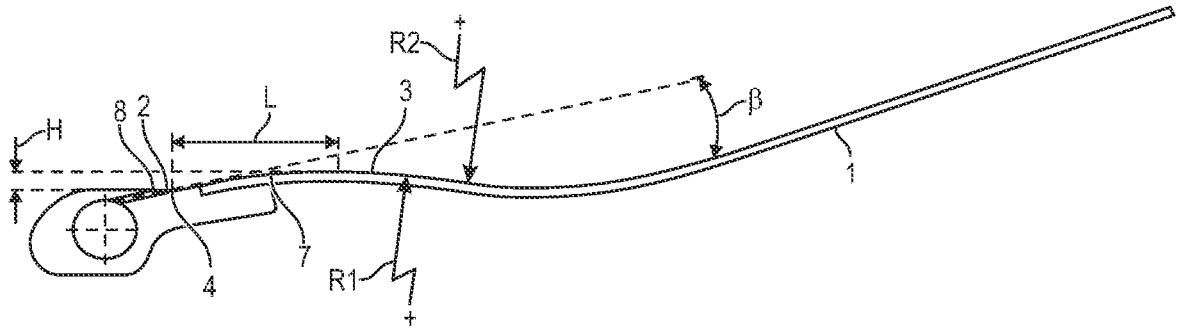
Figure 5C:
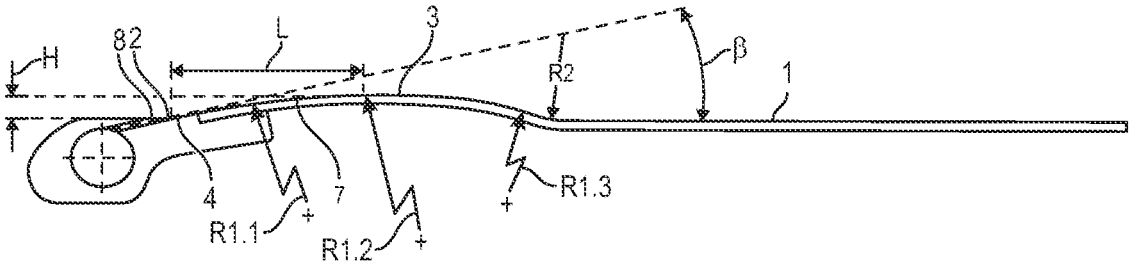

Owing to what is presented above, the shape of the curved guide plate 1 is difficult to specify on the basis of just the dimensions; more particularly, an unambiguous mathematical definition of the shape of the curve is difficult. This is made more difficult, also, because the curved shape of the guide plate 1 varies depending on the application. That being the case, the shape of both the bump 3 and of the surface 5 of the curved guide plate 1, and the length L, height H and angle β of the curve, as well as the radius R are dimensioned on a case-by-case basis in the manner required by different applications, and are finally tailored on-site to be optimal. FIG. 5A presents by way of example the shape of both the bump 3 and the surface 5 of a curved guide plate 1, wherein the length L of the bump 3 is in the range 20-300 mm, depending on the length of the threading guide plate 1 and the distance from the tail end 6 to be transferred. The most suitable length is 50-150 mm, in this exemplary embodiment L=75 mm. More precisely specified, L is the length from the discharge aperture to the highest point of the bump 3 from the nozzle 8.

The height H of the bump 3 means the difference of the nozzle 8 of the discharge aperture and the surface 5 of the bump 3. What is essential is the difference of the surface 5 in relation to the nozzle 8 of the discharge aperture, i.e. that it is situated at some desired height H. In other words, depending on the point at which the nozzles 8 of the discharge apertures are situated, the nozzles 8 can be higher, lower or at the same height with respect to the surface 5; this dimension is defined as the height H. In the exemplary embodiment, the height H of the bump 3 from the plane surface is 0.1-50 mm, most preferably 2-10 mm, in this exemplary embodiment H=6 mm.

The angle β between the blown air 2 and the surface of the guide plate 1 after the bump 3 is selected freely according to the different points. More precisely specified, the angle β is the contact angle or rounding of the bump 3 and the curved guide plate 1. In this exemplary embodiment, β=13°, in other words, the angle β between the blown air 2 and the surface of the guide plate 1 after the bump 3 is positive, i.e. bends in a slope downwards, the angle is +β. Another alternative is the embodiment according to FIG. 5B, in which the flat section of the surface of the guide plate 1 is formed into an upward slope in relation to the bump 3, the angle is −β, i.e. negative.

In the embodiment of FIG. 5A, the radius $R_1$ of the bump 3 is in the range 10-500 mm, most suitably 100-300 mm, in this exemplary embodiment $R_1$=199 mm, and the radius $R_2$ is in the range 20-400 mm, most suitably 50-200 mm, in this exemplary embodiment $R_2$=166 mm. Defined more precisely, if the bump 3 is of a circular type, $R_1$ is the radius of the bump 3. $R_2$ is the radius of the countercircle, with which the bump 3 is connected to the flat section. The shape of the bump 3 can vary according to need; it can be a slope from the entry side of the air flow 4 and a double curve curving to the surface of the flat guide plate 1. According to FIG. 5C, $R_1$ can also be composed of two or more different-sized circles, e.g. a gentle curve $R_{1.1}$ after the air blowing 2, and a tightening curve $R_{1.2}$ at the highest point of the bump 3, and a further tightening curve $R_{1.3}$ towards the flat plate of the guide plate 1.

Figure 6A:
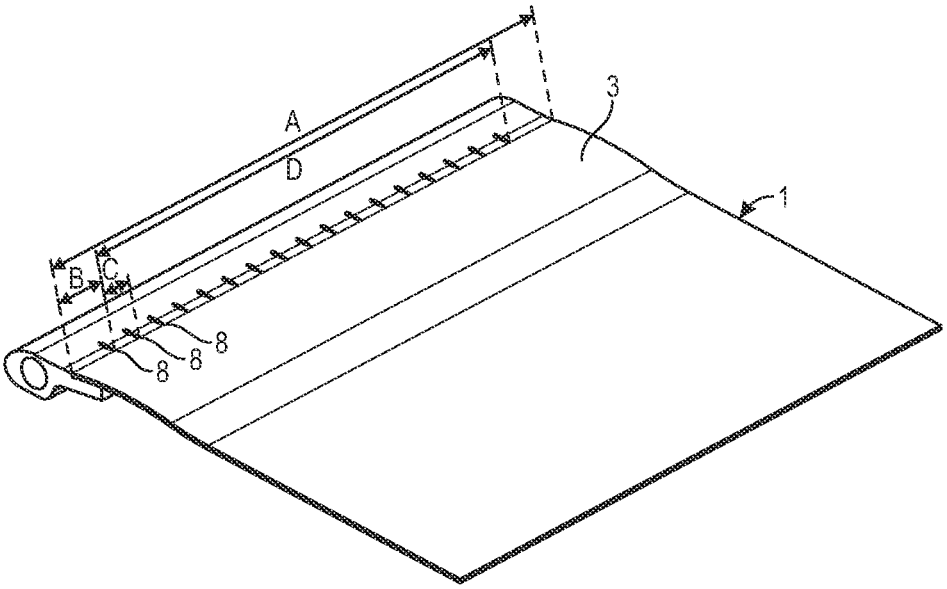

In addition to this, the nozzles 8 of the air discharge apertures of the blown air 2 can be formed in a number of ways. According to one embodiment of the invention, the quantity of nozzles 8 required by the usage location are installed at different points of the curved guide plate 1. FIG. 6A presents a curved guide plate 1 having a width A=390 mm and in which the nozzles 8 of the air discharge apertures are at a distance B=35 mm from the side end of the plate with a distribution of C=20 mm in such a way that the width covered by the nozzles 8 is D=320 mm.

Figure 10A:
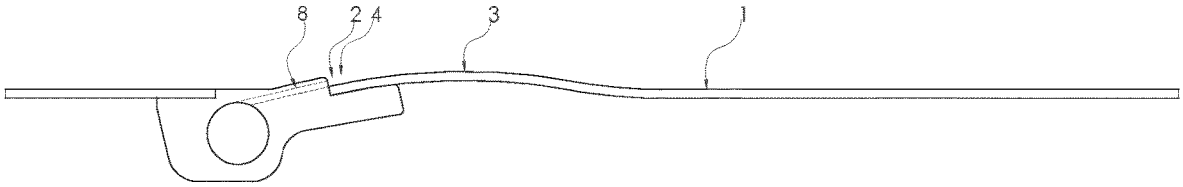
Figure 10B:
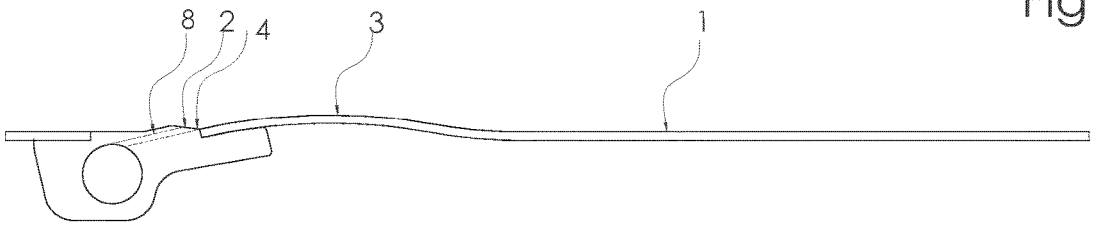
Figure 10C:
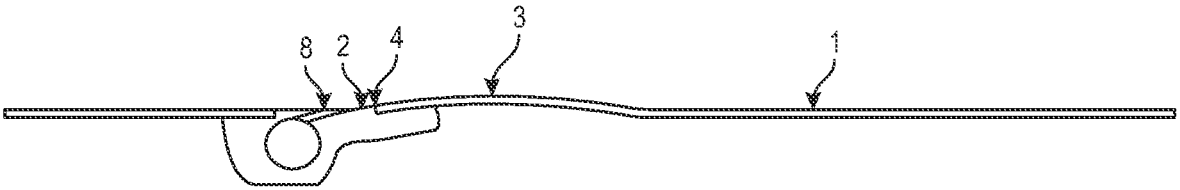

Furthermore, the nozzles 8 can blow at different angles +/−α onto the surface of the curved guide plate 1, depending on the type of nozzle 8 and on the task. According to one embodiment of the invention, some of the nozzles 8 are pull nozzles, in other words the maximum tension force is sought, and some are hold nozzles with which controllability is managed. FIGS. 10A and 10B describe a steep and a slope-type step nozzle that have a step and are suitable as hold nozzles in the solution according to the invention. These differ substantially from the even pull nozzles according to FIG. 10C that have no step. With a suitable combination of these, the passage of the tail end 6 is optimized.

Figure 6B:
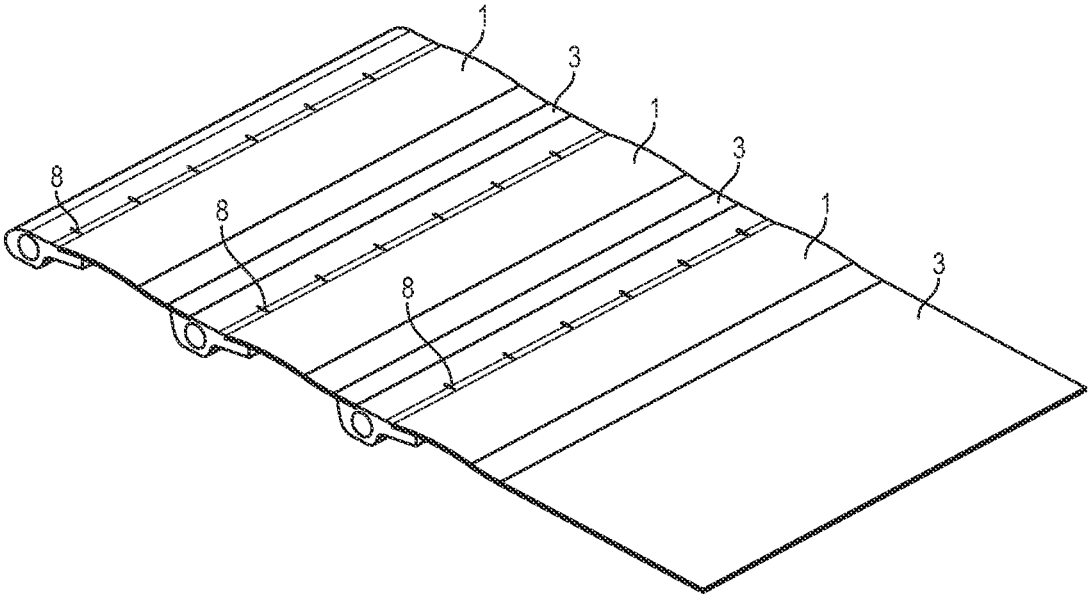
Figure 6B:
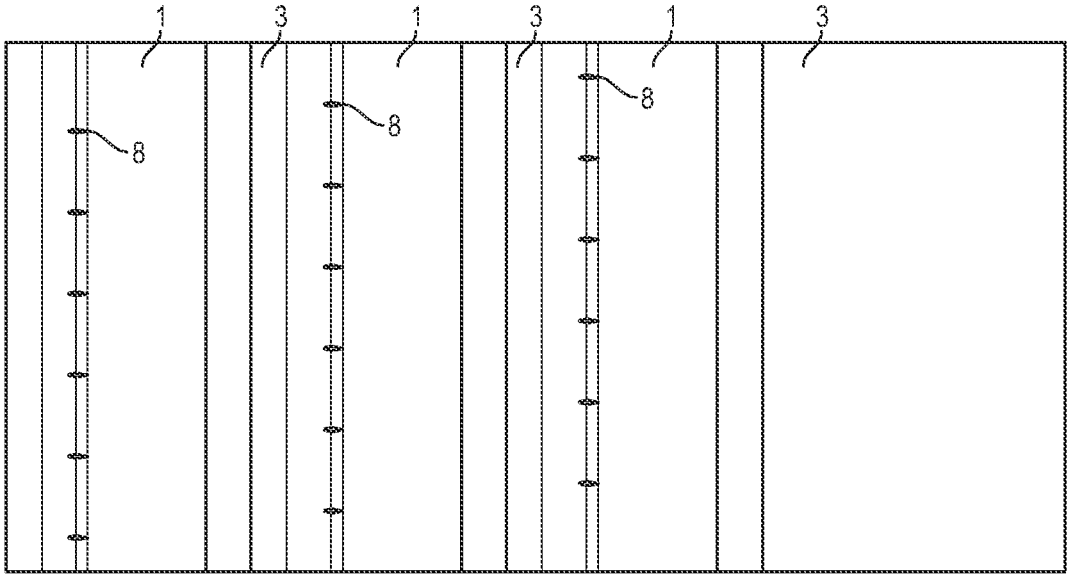

One preferred embodiment is the solution according to FIG. 6B, in which is e.g. a 3 m long plate and in which there are nozzles 8, at 300 mm intervals. Some of the nozzles 8 are hold nozzles and some are even pull nozzles that guide towards the bump 3 for guiding the tail end 6. The surface of the curved guide plate 1 after the bump 3 is shaped according to the different operational needs; it can be an essentially even and straight plane, curved, or the next bump 3 starts from it. In this way, one larger entity is formed that here we call a guidance system. According to FIGS. 8A-8C, this type of guidance system can curve as desired, e.g. evenly for the whole distance, or it can be straight for some of the distance and then coil e.g. around a roll for some distance. According to FIGS. 9A-9C, the guidance system can be made from one integral guide plate 1, in which same plate a number of bumps 3 are formed. There can be a hinge structure in the guide plate 1, or it can be made from a thinner or flexible plate so that it can coil. Most preferably, the guidance system is made from parts, from a number of guide plates 1, which are fastened to each other in such a way that a plurality of curved guide plates 1 are connected into one larger web feeding guidance system. The guide plates 1 are fastened to each other from more than one plate, the plates being either similar or different, most preferably from 2-10 curved guide plates 1. In this way, the desired guide plate entity, i.e. guidance system, is formed, which guides the tail end 6 either straight and/or curving in the desired manner, and that the guidance system comprises various nozzles 8 and also bumps 3.

Figure 3A:
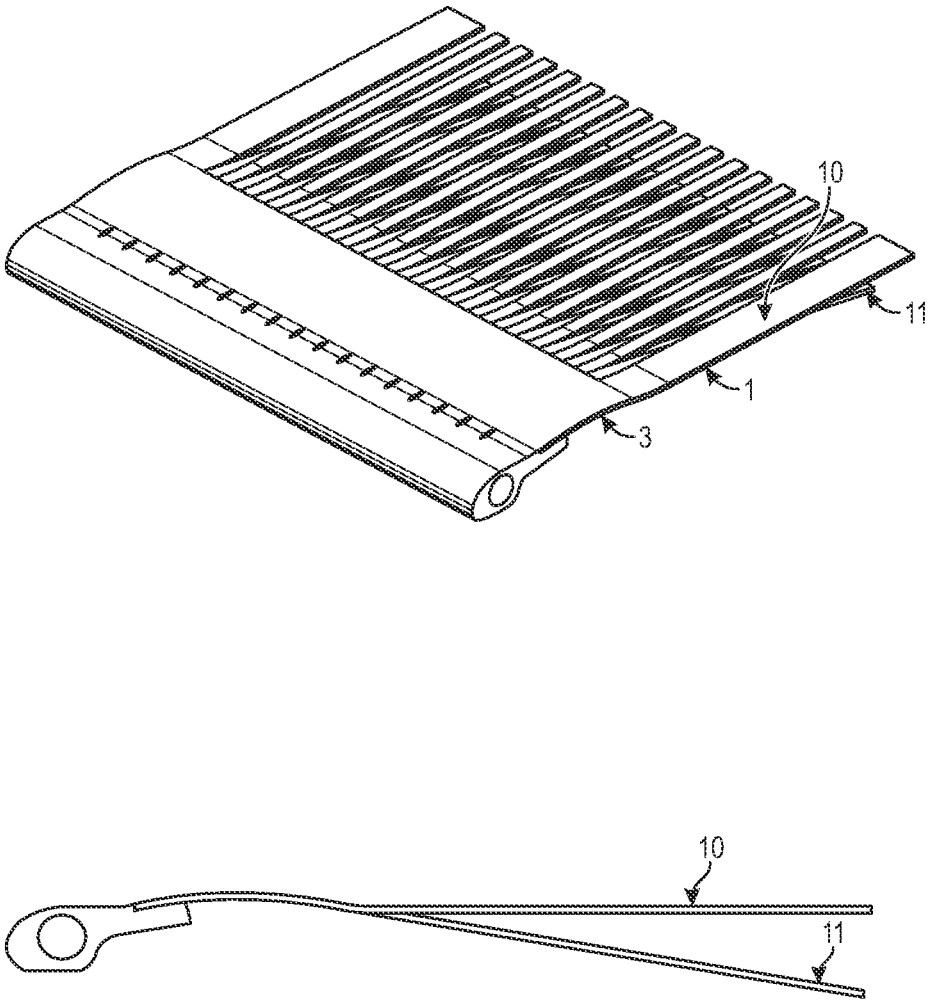
Figure 3B:
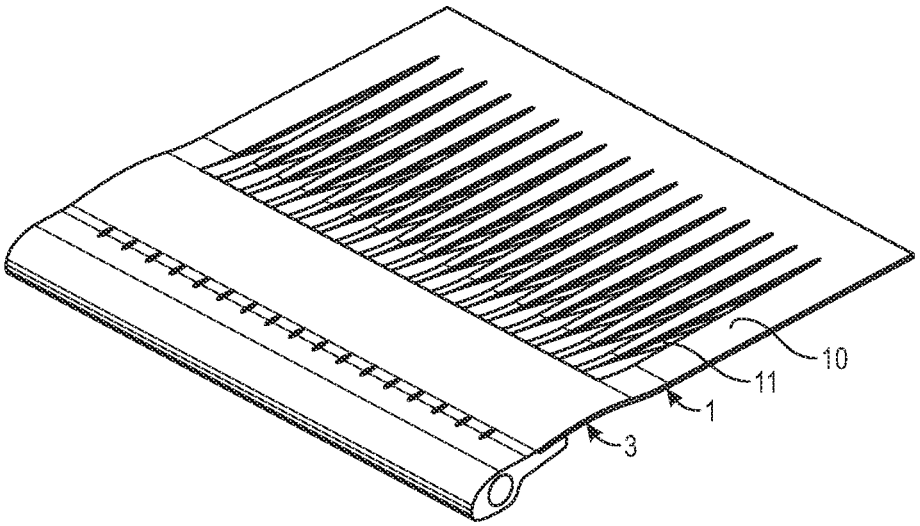
Figure 3B:
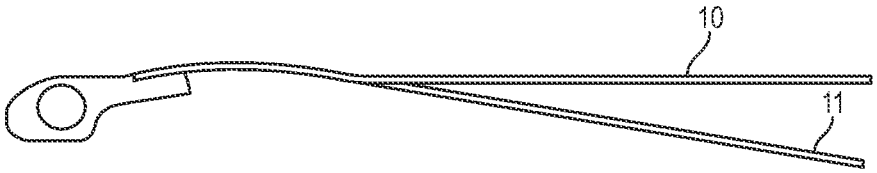

According to FIGS. 3A-3B, the section of the guide plate 1 starting after the surface 5 of the curved guide plate 1 can, according to a particularly preferred embodiment, continue both curving 11 and straight 10. In other words, 10 mm battens or narrow grooves, i.e. longitudinal gaps of different sizes, are cut from the plate, of which most preferably every alternate gap continues straight and every other alternate gap bends downwards as an extension of the curved part. In this way, some of the blown air 2 can be ejected through the flat part 10 and thus the tail end 6 can be brought under control, on top of the battens that continue straight, and into contact with the curved surface 11. The grooves in the embodiment of FIG. 3A go to the end of the guide plate 1 and in FIG. 3B they are formed in only a part of the guide plate 1. What is essential, however, is that the purpose of the batten is not to go through the bump 3, but instead to start after the bump 3. This embodiment is advantageous in precise situations, e.g. through a roll nip, in which the tail end 6 must be transported through a small gap and it should be as straight and even as possible.

According to what is presented in the preceding, from the standpoint of the invention an essential embodiment is when the blown air 2 can be guided onto the surface 5 of the curved guide plate 1 without any shoulder or angle α (0°), and without producing any friction. This way, the maximum tension force is achieved. With solutions according to the state-of-the-art this is impossible; there is always a blowing angle between the guide plate and the bores of the nozzles. It is technically impossible to bore holes in the nozzles in exactly the same direction as the surface of a flat plate. For example, in specification FI 123352, in which the angle between the blowing direction of the bores and the guide plate must be between +5°-+30° degrees. Essential improvements are achieved with the solution according to the invention compared to the prior art presented above, in which the air discharges through the plates at a small angle to the bored holes.

The invention can also be applied in two ways; either in such a way that the nozzles 8 of the air discharge apertures of the blown air 2 are prefabricated in the curved guide plate 1. This type of nozzle structure 8, which is made as a fixed part of the curved guide plate 1, is suited according to FIG. 7B in particular in threading in the drying section of a paper machine, in which the blowing is in two directions.

Figure 7A:
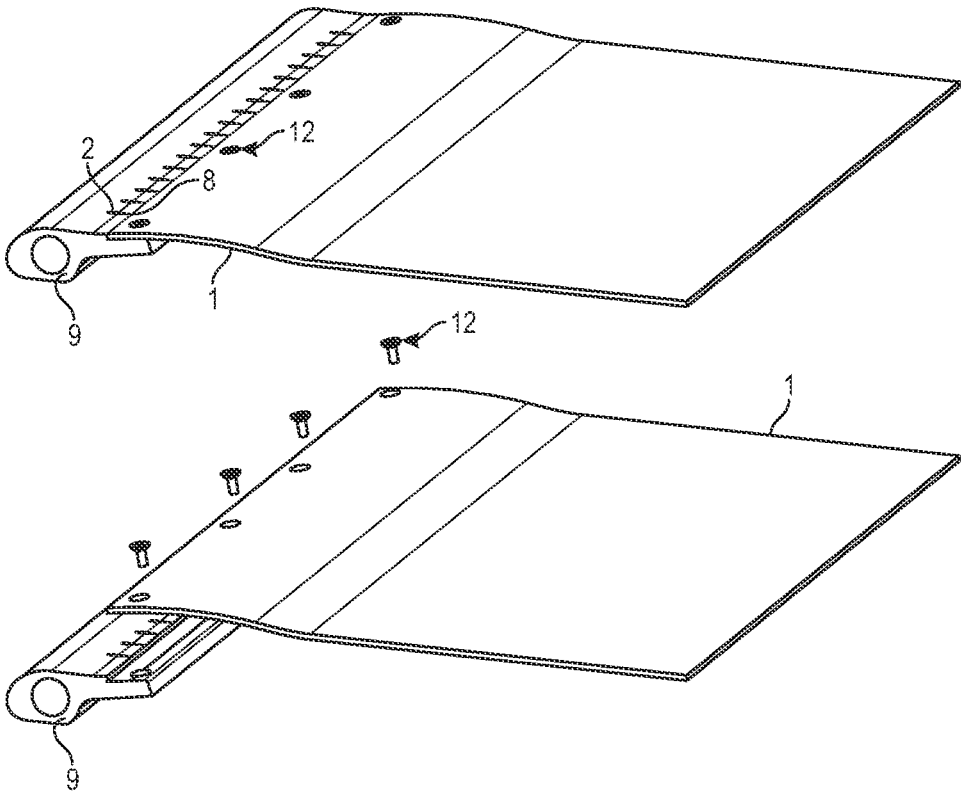
Figure 7B:
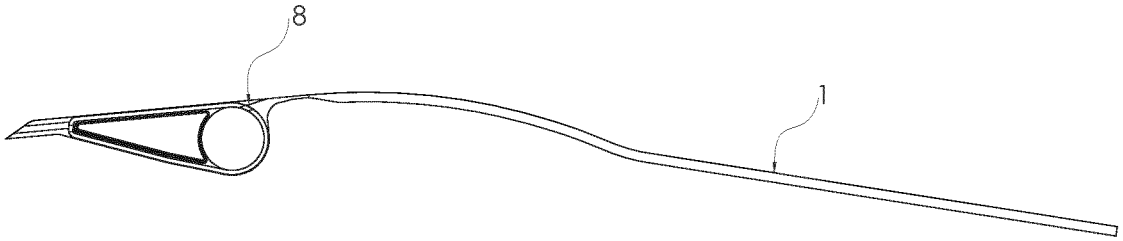
Figure 8A:
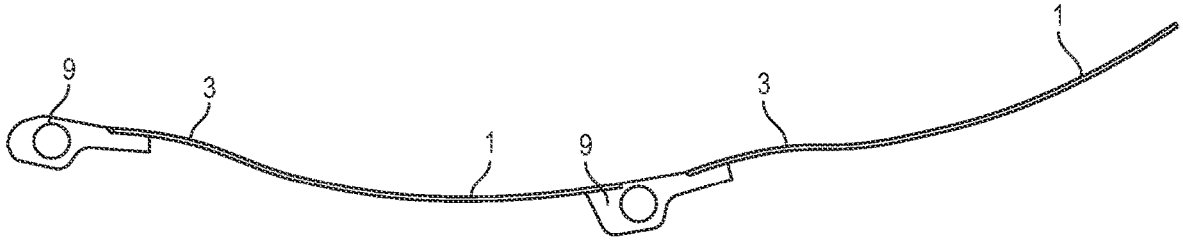
Figure 8B:
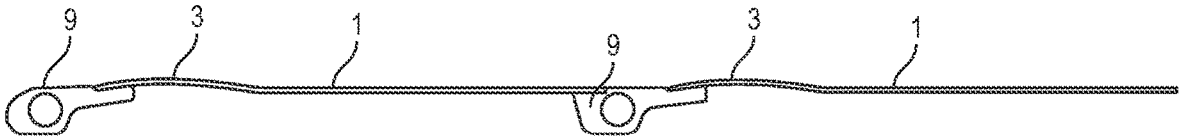
Figure 8C:
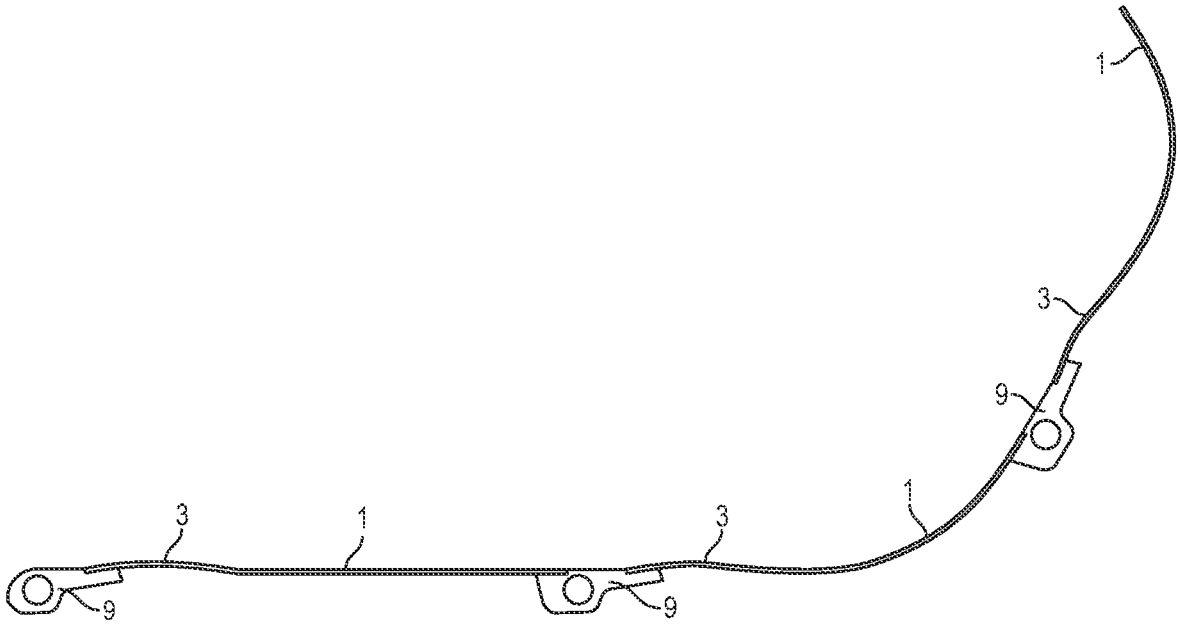
Figure 9A:
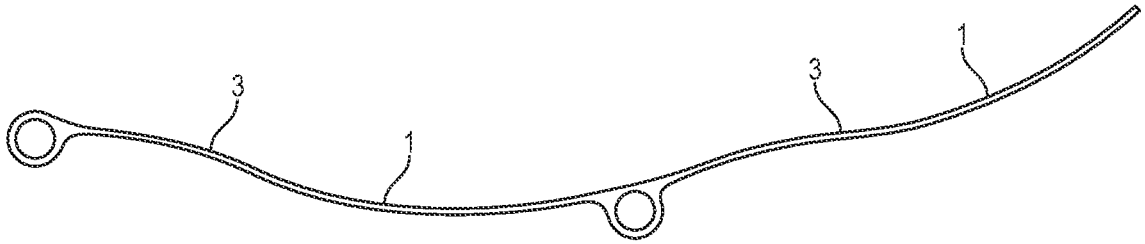
Figure 9B:
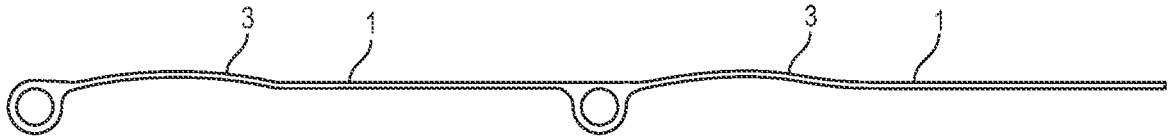
Figure 9C:
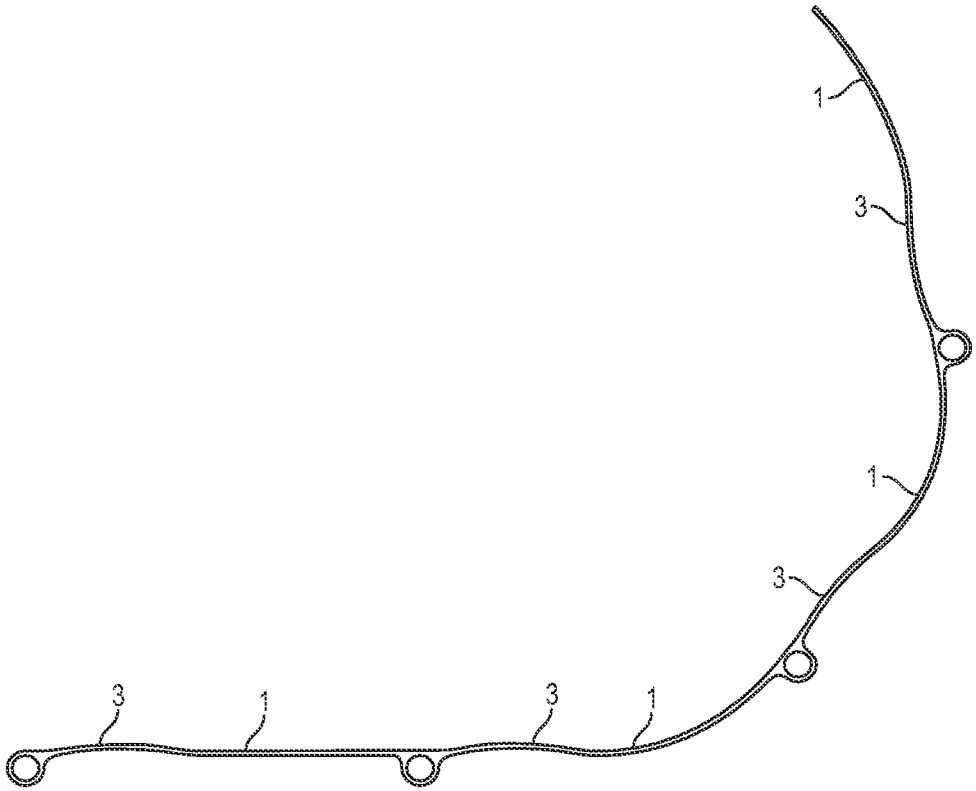

Another very important embodiment is presented in FIG. 7A in such a way that the nozzles 8 are made in a separate profile, i.e. into a separate nozzle frame 9, onto which the curved guide plate 1 is installed. This type of nozzle frame 9 is fabricated from a separate profile, in which nozzles 8 are formed in such a way that the nozzle structure 8 can be stepped, angled or planar, and the guide plate 1 is installed with fastening means 12 onto the nozzle frame 9, forming an integral entity. These different variations can, of course, be varied according to need. This type of replaceable nozzle frame 9-guide plate 1 combination is an extremely good solution from the standpoint of the invention; in such a case, the threading event can be adjusted/optimized in situ by changing the nozzle structure 8 and/or guide plate profile.

It is obvious to the person skilled in the art that the invention is not limited to the embodiments presented above, but that it can be varied within the scope of the claims presented below.

The invention claimed is:

1. An apparatus for transporting a tail end in a fiber web machine from one structural section to another, the apparatus comprising:

one or more nozzles formed in a nozzle frame and configured to direct blown air, the directed blown air defining an air flow for transporting the tail end in a controlled fashion in a direction parallel to the air flow; and a guide plate directly coupled to the nozzle frame and having a streamlined surface configured to guide the air flow along the streamlined surface, the one or more nozzles configured to direct the blown air onto the streamlined surface at an angle α, the angle α either ranging between being less than 0° and greater than or equal to −50° or ranging between being greater than 0° and less than or equal to 20°, the streamlined surface including a bump and a surface portion located downstream from the bump with respect to the air flow.

2. The apparatus of claim 1, wherein a side profile of the bump is symmetrically convex with respect to a midpoint between an upstream side of the bump and the downstream side of the bump, the upstream side and the downstream side being relative to the air flow.

3. The apparatus of claim 1, wherein the angle α either ranges between being less than 0° and greater than or equal to −15° or ranging between being greater than 0° and less than or equal to 5°.

4. The apparatus of claim 1, wherein the one or more nozzles are configured to direct the blown air onto the bump.

5. The apparatus of claim 1, further comprising a second surface portion located upstream from the bump with respect to the air flow.

6. The apparatus of claim 5, wherein the one or more nozzles are configured to direct the blown air onto the second surface portion.

7. The apparatus of claim 1, wherein the surface portion located downstream from the bump further comprises one or more narrow grooves that bifurcate the surface portion into a first surface and a second surface, wherein the first surface guides a first portion of the air flow along the first surface and the second surface guides a second portion of the air flow along the second surface.

8. The apparatus of claim 1, wherein the one or more nozzles have at least one of a stepped, an angled, or a planar configuration with respect to the guide plate.

9. The apparatus of claim 1, wherein the nozzle frame is configured to receive a second guide plate, wherein the second guide plate is located upstream to the nozzle frame with respect to a second air flow, wherein the second air flow is produced by another one or more nozzles configured to direct blown air onto the second guide plate.

10. The apparatus of claim 1, wherein the guide plate is a flexible structure.

11. The apparatus of claim 1, wherein an angle (β is formed between the blown air from the one or more nozzles and the surface portion located downstream from the bump.

12. The apparatus of claim 11, wherein the angle (β is negative such that the surface portion includes an upward slope in relation to the bump.

13. The apparatus of claim 1, wherein the angle α ranges between being greater than 0° and less than or equal to 20°.

14. The apparatus of claim 1, wherein the guide plate is coupled to the nozzle frame via at least one fastener.

15. A guidance system for transporting a tail end in a fiber web machine from one structural section to another, the guidance system comprising:

a plurality of nozzle frames, each nozzle frame having a respective one or more nozzles formed in the respective nozzle frame and configured to direct blown air, the directed blown air defining an air flow for transporting the tail end in a controlled fashion in a direction parallel to the air flow; and a plurality of guide plates, each guide plate directly coupled to a respective nozzle frame, at least one guide plate among the plurality of guide plates being coupled to a respective nozzle frame and another nozzle frame located downstream from the respective nozzle frame with respect to the air flow, each guide plate having a respective streamlined surface configured to guide the air flow along the streamlined surface, each streamline surface including a bump and a surface portion located downstream from the bump with respect to the air flow.

16. The guidance system of claim 15, wherein the respective one or more nozzles of each guide plate is configured to direct the blown air onto the respective streamlined surface at an angle $\alpha$, the angle $\alpha$ ranging between $-50°$ to $20°$.

17. A method for transporting a tail end in a fiber web machine from one structural section to another, the method comprising:

directing blown air from a nozzle formed in a nozzle frame onto a guide plate directly coupled to the nozzle frame, the directed blown air defining an air flow for transporting the tail end in a controlled fashion in a direction parallel to the air flow, the guide plate having a streamlined surface configured to guide the air flow along the streamlined surface, the streamlined surface including a bump and surface portion located downstream from the bump with respect to the air flow, wherein the directed blown air and the streamlined surface define an angle $\alpha$, the angle $\alpha$ either ranging between being less than $0°$ and greater than or equal to $-50°$ or ranging between being greater than $0°$ and less than or equal to $20°$.

18. The method of claim 17, wherein directing the blown air onto the guide plate further comprises directing the blown air onto the bump.

19. The method of claim 17, further comprising a second surface portion located upstream from the bump with respect to the air flow.

20. The method of claim 19, wherein directing the blown air onto the guide plate further comprises directing the blown air onto the second surface portion.

* * * * *